US011686543B1

(12) United States Patent
Sugg

(10) Patent No.: US 11,686,543 B1
(45) Date of Patent: Jun. 27, 2023

(54) FIREARM, TOPCOVER ASSEMBLY, FEED LEVER, AND METHODS OF USE THEREOF

(71) Applicant: Edward Sugg, South Riding, VA (US)

(72) Inventor: Edward Sugg, South Riding, VA (US)

( * ) Notice: Subject to any disclaimer, the term of this patent is extended or adjusted under 35 U.S.C. 154(b) by 0 days.

(21) Appl. No.: 17/475,165

(22) Filed: Sep. 14, 2021

Related U.S. Application Data

(60) Provisional application No. 63/177,383, filed on Apr. 20, 2021, provisional application No. 63/151,801, filed on Feb. 22, 2021, provisional application No. 63/078,306, filed on Sep. 14, 2020.

(51) Int. Cl.
*F41A 9/32* (2006.01)
*F41A 3/66* (2006.01)

(52) U.S. Cl.
CPC . *F41A 9/32* (2013.01); *F41A 3/66* (2013.01)

(58) Field of Classification Search
CPC ..... F41A 3/66; F41A 9/32; F41A 9/33
USPC ..... 89/33.2
See application file for complete search history.

(56) References Cited

U.S. PATENT DOCUMENTS 4,492,145 A * 1/1985 Curtis ..... F41A 21/484 89/33.2
5,227,578 A * 7/1993 Reynolds ..... F41A 3/34 89/186
10,746,493 B1 * 8/2020 Steimke ..... F41A 9/29
2015/0267984 A1 * 9/2015 Kokinis ..... F41A 19/33 42/14

FOREIGN PATENT DOCUMENTS

GB 1186020 A * 4/1970 ..... F41A 9/32

* cited by examiner

*Primary Examiner* — Bret Hayes
(74) *Attorney, Agent, or Firm* — ArentFox Schiff LLP

(57) ABSTRACT

A firearm, top cover, and feed lever. The feed lever includes a feed lever body having a feed lever track, wherein the feed lever body is configured to be pivotally mounted within a topcover assembly, and wherein the feed lever body is configured to pivot in response to a force transmitted by a roller of an operating group to the feed lever track during cycling of the firearm. The feed lever further includes a feed lever track first end, wherein the feed lever track first end comprises a feed lever track exit portion configured to receive the roller of the operating group after the roller exits the feed lever track via the feed lever track exit portion as the firearm cycles.

14 Claims, 23 Drawing Sheets

1100

1100

1100

FIREARM, TOPCOVER ASSEMBLY, FEED LEVER, AND METHODS OF USE THEREOF

CROSS REFERENCE TO RELATED APPLICATIONS

This application claims priority to:

U.S. Provisional Application No. 63/078,306, filed on Sep. 14, 2020, titled: Improvements to Light and Medium Machineguns;

U.S. Provisional Application No. 63/151,801, filed on Feb. 22, 2021, titled: Machinegun Improvements; and U.S. Provisional Application No. 63/177,383, filed on Apr. 20, 2021, titled: MG and Barrel Improvements.

The entirety of the provisional patents above are expressly incorporated herein by reference.

BACKGROUND

The squad automatic weapon ("SAW"), and derivatives and variants has been in production for about 44 years (first offered around 1976), and has been used by the US Military ("DOD") since about 1984. During that time it has undergone improvements including a US DOD Product Improvement Program. It has also been produced by about a dozen countries in both Licensed and Unlicensed production. It is the dominant "light" machinegun ("LMG") in the Western World, and is in service with several dozen countries.

SUMMARY

The following aspects and aspects thereof are described and illustrated in conjunction with systems, tools and methods which are meant to be exemplary and illustrative, not limiting in scope.

In one aspect of the disclosure a topcover usable with a firearm is disclosed. The firearm includes a receiver configured to slideably support an operating group having a roller, wherein the operating group and roller moves cycles forward and rearward while constrained by the receiver as the firearm cycles. The firearm further includes a topcover assembly having a feed lever pivotally mounted thereto, wherein the topcover assembly is configured to advance cartridges to be fired by the firearm. The topcover assembly further includes a feed lever having a feed lever track configured to slideably receive the roller, wherein the feed lever comprises a feed lever first end with a feed lever track exit portion, and wherein the roller exits and re-enters the feed lever track via the feed lever track exit portion end as the firearm cycles.

In one aspect of the disclosure a topcover assembly is disclosed. The topcover assembly includes a feed lever pivotally mounted thereto, wherein the topcover is configured to advance cartridges to be fired by the firearm. The topcover assembly include a feed lever having a feed lever track configured to slideably receive a roller of the operating group, wherein the feed lever comprises a feed lever first end with a feed lever track exit portion, and wherein the roller exits and re-enters the feed lever track via the feed lever track exit portion end as the firearm cycles.

In one aspect of the disclosure a feed lever usable with a firearm is disclosed. The feed lever includes a feed lever body having a feed lever track, wherein the feed lever body is configured to be pivotally mounted within a topcover assembly, and wherein the feed lever body is configured to pivot in response to a force transmitted by a roller of an operating group to the feed lever track during cycling of the firearm. The feed lever further includes a feed lever track first end, wherein the feed lever track first end comprises a feed lever track exit portion configured to receive the roller of the operating group after the roller exits the feed lever track via the feed lever track exit portion as the firearm cycles.

In addition to the example aspects and aspects described above, further aspects and aspects will become apparent by reference to the drawings and by study of the following detailed description.

BRIEF DESCRIPTION OF THE DRAWINGS

Example aspects are illustrated in the drawings. It is intended that the aspects and figures disclosed herein are to be considered illustrative rather than restrictive.

DETAILED DESCRIPTION

Figure 1:
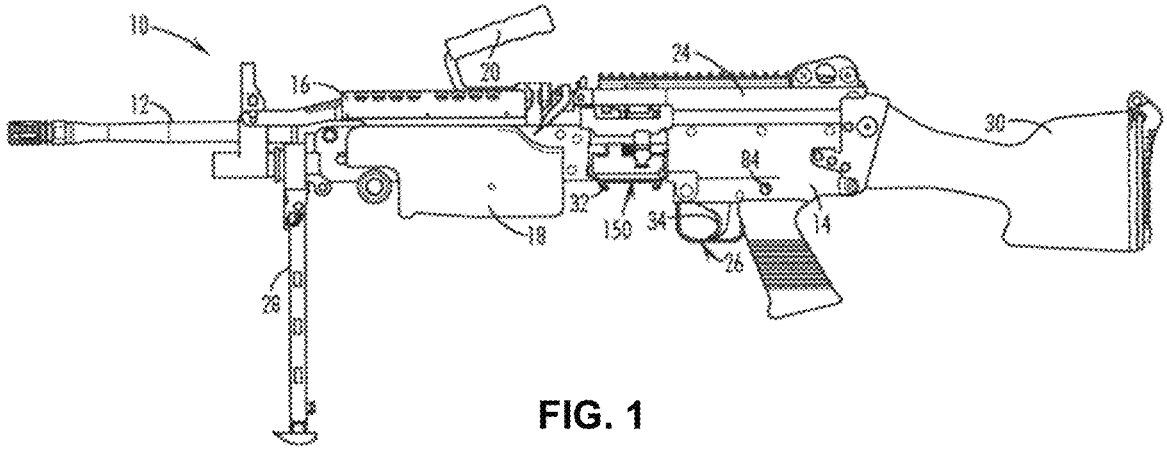
FIG. 1 Related Art
FIG. 1 is a left side view of one example of a firearm usable with aspects disclosed herein.

In the following detailed description, reference is made to the accompanying figures, which form a part thereof. In the figures, similar symbols typically identify similar components, unless context dictates otherwise. The illustrative aspects described in the detailed description, figures, and claims are not meant to be limiting. Other aspects may be utilized, and other changes may be made, without departing from the spirit or scope of the subject matter presented herein. It will be readily understood that the aspects of the present disclosure, as generally described herein, and illustrated in the figures, can be arranged, substituted, combined, separated, and designed in a wide variety of different configurations, all of which are explicitly contemplated herein.

The following includes definitions of selected terms employed herein. The definitions include various examples and/or forms of components that fall within the scope of a term and that may be used for implementation. The examples are not intended to be limiting. Further, it will be obvious to one skilled in the art that the present disclosure may be practiced without these specific details. In other instances, well-known methods, procedures, and components have not been described in detail so as to not unnecessarily obscure aspects of the present disclosure.

Throughout the disclosure, the term substantially or approximately may be used as a modifier for a geometric relationship between elements or for the shape of an element or component. While the terms substantially or approximately are not limited to a specific variation and may cover any variation that is understood by one of ordinary skill in the art to be an acceptable variation, some examples are provided as follows. In one example, the terms substantially or approximately may include a variation of less than 10% of the dimension of the object or component. In another example, the terms substantially or approximately may include a variation of less than 5% of the object or component. If the terms substantially or approximately are used to define the angular relationship of one element to another element, one non-limiting example of the terms may include a variation of 5 degrees or less. These examples are not intended to be limiting and may be increased or decreased based on the understanding of acceptable limits to one of ordinary skill in the art.

For purposes of the disclosure, directional terms are expressed generally with relation to a standard frame of reference when the firearm is in an in-use read-to-fire orientation.

The FABRIQUE NATIONALE D'HERSTAL ("FN") MINIMI platform includes many variants. Subsequent variants of the FN MINIMI include the DOD-designation M249, MK46, MK48, and the MGA SAW. The firearms mentioned throughout the disclosure may hereinafter be interchangeably referred to as the SAW et al. As used herein, "M249 platform" should be understood to encompass any firearm derived from the FN MINIMI design including, but not limited to, the M249 firearm. The M249 platform is an open-bolt, slam fire weapon, but some variants may be a closed-bolt, semi-automatic variant.

Figure 2:
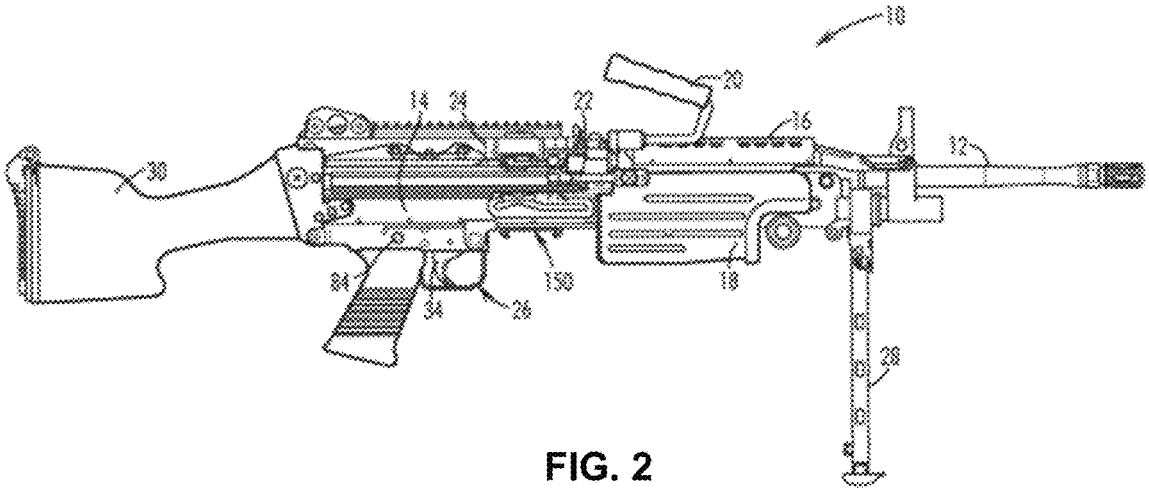
FIG. 2 Related Art
FIG. 2 is a right side view of the example firearm of FIG. 1.

FIGS. 1 and 2 show left and right side views, respectively that are commonly present in an FN platform firearm 10. The firearm may include a barrel 12, a receiver 14, a heat shield 16, and a hand guard 18. The firearm may further include a carrying handle 20, a charging handle 22, and a cover plate 24. Below receiver 14 is a trigger assembly 26. Attached to barrel 12 is a bipod 28. On the proximal end of rifle 10 is a buttstock 30. Additional aspects and details of a closed-bolt variant of the M249 platform are described with respect to FIGS. 3 and 4 below. Any description of a closed-bolt variant should be understood to be merely illustrative and not be understood to exclude the more common open-bolt M249 platform firearms or other platforms, for example.

Figure 3:
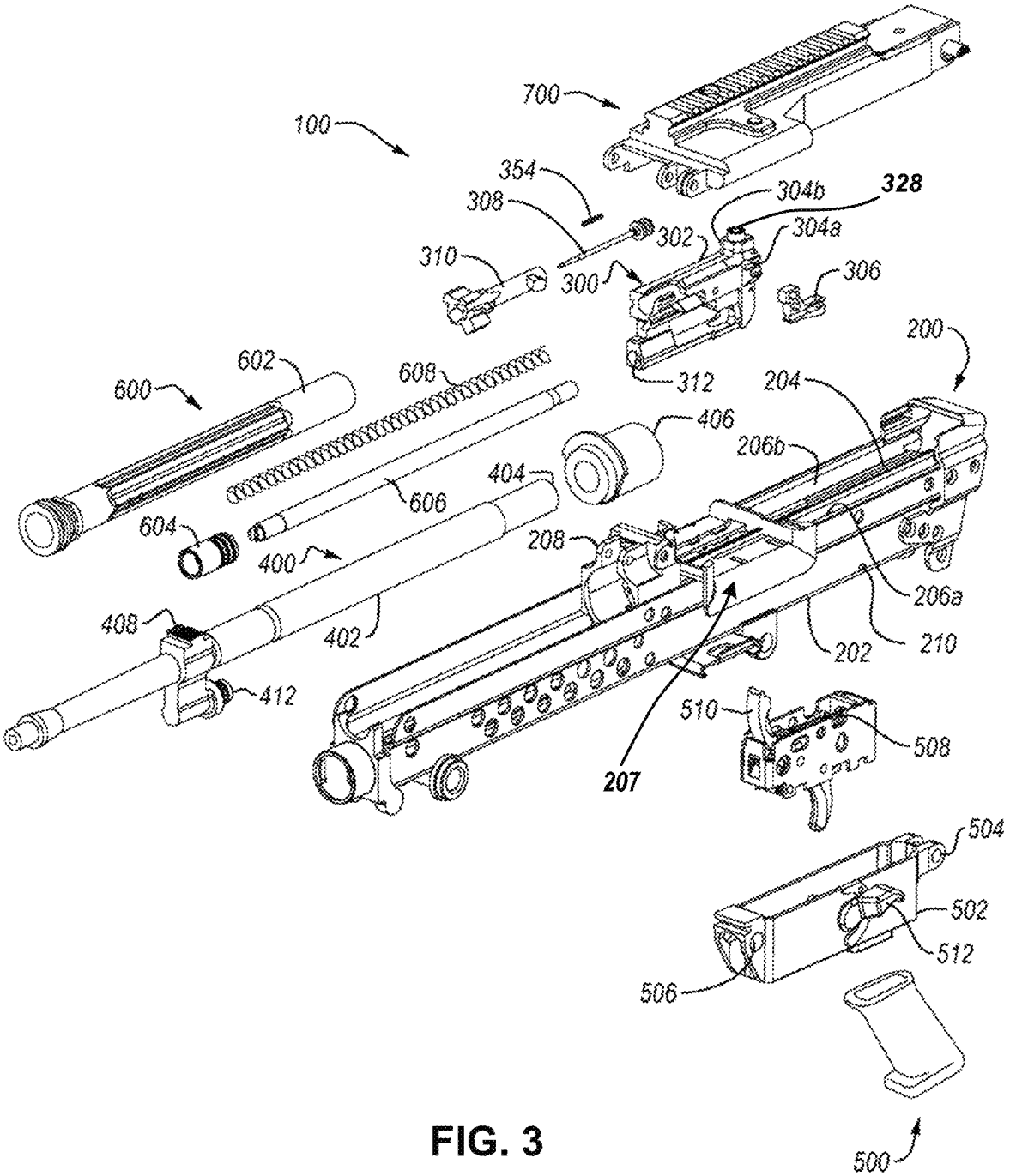
FIG. 3 Related Art
FIG. 3 is an isometric exploded view of one example of a firearm usable with aspects disclosed herein.

FIGS. 2 and 3 show isometric exploded views of the main operational components of a firearm 100 usable with aspects of the current disclosure. FIG. 3 shows a lower isometric exploded view of the main components of the firearm 100. The firearm 100 may include a receiver 200, which may carry upon it various information engraved or otherwise affixed thereto. The information on the receiver 200 may commonly include model designation and identification information unique to that receiver to identify the firearm 100 for registration and ownership purposes. The receiver 200 may also enable the connection and assembly of many of the operational components on or in the receiver 200. For example, the receiver 200 includes a receiver body 202 that defines an interior channel 204 with left and right receiver rails 206*a*, 206*b* affixed thereto. The left receiver rail 206*a* and right receiver rail 206*b* may be symmetrical with respect to one another, or they may be asymmetrical. For example, the left receiver rail 206*a* and the right receiver rail 206*b* may have differing thicknesses or they may be positioned differently in the interior channel 204. The right receiver rail 206*b* and the left receiver rail 206*a* may be interchangeably referred to as the right receiver guide and left receiver guide, respectively. The left receiver rail 206*a* may be thicker or thinner than the right receiver rail 206*b*. Additionally or alternatively, the left receiver rail 206*a* may be positioned higher or lower than the right receiver rail 206*b*. Furthermore, the left receiver rail 206*a* may be longer or shorter longitudinally within the interior channel 204 than the right receiver rail 206*b*. The receiver 200 further comprises a selector stop 210. The receiver may have attached thereto a feed tray 207. In one example, the feed tray 207 may for example be pivotally mounted to the receiver 202.

The operating group 300, which may interchangeably be referred to throughout the disclosure as the OP group may be slidably connected to the receiver 200 by the left and right receiver rails 206*a*, 206*b*. The operating group 300 having an elongate upper section in which there are left and right longitudinal recessions 304*a*, 304*b*. The left and right longitudinal recessions 304*a*, 304*b* receive the left and right receiver rails 206*a*, 206*b*, respectively, to allow the longitudinal movement of the operating group 300 within the interior channel 204 of the receiver 200. The operating group 300 further includes a firing block 306 that is disposed at least partially inside the integrated slide-carrier 302. Alternatively, the firing block 306 may be disposed entirely externally to the integrated slide-carrier. The firing block 306 transmits a force to the firing pin assembly 308, which is at least partially disposed within a bolt 310. The bolt 310 includes notches, grooves, channels, or threads for selectively connecting to another, complementary connector. The operating group 300 further includes a roller 328 that is configured to be movably constrained within a channel of a feed lever 310 (FIG. 4) that is pivotably mounted within the topcover assembly 700. Additional aspects of the feed lever and interaction between the feed lever and the roller 328 are described in further detail below with respect to FIGS. 6A and 6B.

The receiver 200 may also include a central trunnion 208 into which the barrel assembly 400 connects. The barrel assembly 400 comprises a barrel body 402 that includes a bore 404 therethrough. The bore 404 provides communication between the barrel body 402 and a barrel extension 406. Together, the barrel extension 406 and the bore 404 provide a path through which a bullet (not shown) may exit the firearm 100. The barrel assembly 400 may also include a gas block 408 disposed on the barrel body 402 forward of the barrel extension 406. The gas block 408 covers a gas port 410 and provides fluid communication with a gas block outlet 412. After firing a bullet, rapidly expanding gas may travel the length of the barrel body 402 through the bore 404. As the gas passes the gas port 410, the gas block 408 may channel some of the gas laterally away from the bore 404 and toward the gas block outlet 412. The diverted gas may be expelled through the gas block outlet 412 and provide the motive force to cycle the firearm 100 and prepare for a subsequent firing.

The barrel assembly 400 connects to the receiver 200 by inserting the barrel extension 406 into the central trunnion 208. The barrel extension 406 may connect to the trunnion 208 via threads, a twist lock, a friction fit, a weld, an adhesive or other secure attachment. The connection between the barrel 406 and the trunnion 208 may be selectively attachable to facilitate maintenance and repair of the firearm 100. The barrel extension 406 provides complementary notches, grooves, channels, or threads into which the bolt 310 may be received and selectively secured thereto. The connection of the bolt 310 to the barrel extension 406 provides a selectively securable connection between the barrel assembly 400 and the internal operating group 300. The connection of the operating group 300 and the barrel assembly 400 provides a chamber in which a bullet may be held and fired.

The related art firearm 100 further includes a control assembly 500 disposed on the underside of the firearm 100 and selectively connected to the receiver 200. The control assembly includes a housing 502 with front mounting points 504 and rear mounting points 506. The front mounting points 504 may be a notch that is configured to be received into a recession on the receiver body 202, eyelets for a cross-bar, a snap fit, or other similar selectively securable connection. Similarly, the rear mounting points 506 may be a notch configured to be received into a recession on the receiver body 202, eyelets for a cross-bar, a snap fit, or other similar selectively securable connection. A trigger package 508 is disposed within the housing 502 of the control assembly 500.

Figure 4:
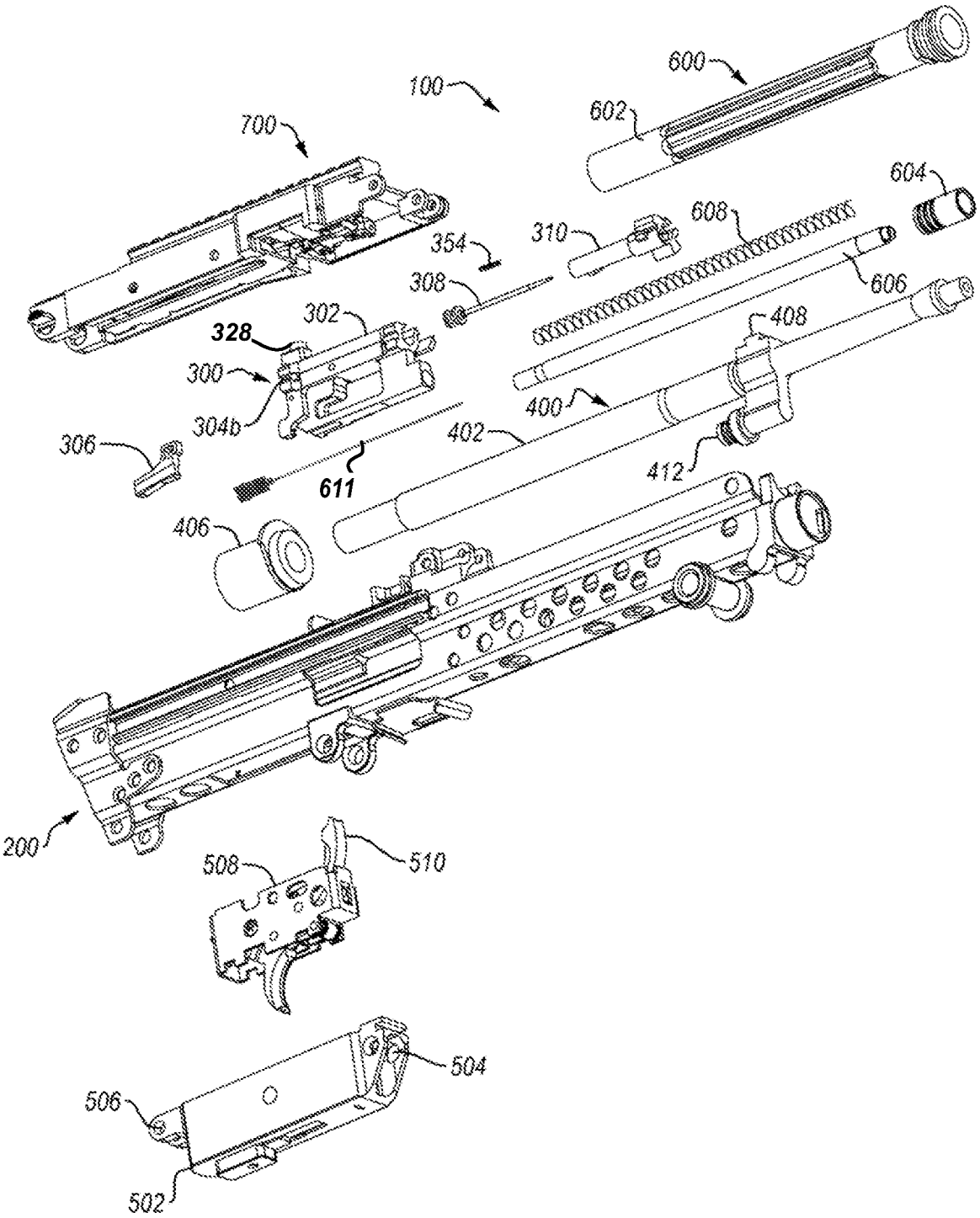
FIG. 4 Related Art
FIG. 4 is a lower isometric exploded view of the example of a firearm of FIG. 3.

The trigger package 508 includes an impulse source such as a hammer 510, as depicted in FIGS. 3 and 4, or a striker or other similar linear actuator. The trigger package 508 may be a commercially available trigger package and may include safe, semi-automatic, 2-round burst, 3-round burst, fully automatic, or other fire operation modes selectable with a fire mode selector switch 512. The trigger package 508 may operate the firearm 100 without modification to the trigger mechanism.

The firearm 100 may further comprises a gas piston assembly 600 that provides a fluid and mechanical linkage between the barrel assembly 400 and the operating group 300. The gas piston assembly 600, which may interchangeably be referred to as an OP piston connects the barrel assembly 400 to the operating group 300 by a gas piston-and-cylinder linkage. The gas tube 602 is disposed around, or otherwise forms a fluid seal with, the gas block outlet 412. The gas block outlet 412 may provide a source of high pressure gas, which may impinge upon a surface of a gas piston 604. The gas piston 604 is connected to a rigid operating rod 606, which may hereinafter bet interchangeably referred to as an OP rod, which is, in turn, connected to the operating group 300. The OP rod 606 is connected to the operating rod connection 312 on the integrated slide-carrier 302 of the operating group 300. The connection between the operating rod 606 and the operating rod connection 312, and the connection between the gas piston 604 and the operating rod 606, may be any connection of sufficient strength to communicate the compressive and tensile forces produced during operation of the firearm 100. For example, the connection may be threads, a twist lock, a friction fit, a weld, an adhesive or other secure attachment. Preferably the connection may be a selective connection facilitating maintenance and repair of the firearm 100, and more preferably, the connection may be adjustable to allow precise tuning of the operation of the firearm 100. The operating group may also include a spring guide rod 611 configured to be contained within the spring 608 when the spring is in the OP rod 606 For example, the connection may be a threaded connection providing a selective and adjustable connection. A threaded connection may further comprise a lateral set screw to retain the connection at the selected relative position.

The OP piston assembly 600 may allow the high pressure gas, the gas contained within the barrel bore 404 and directed through the gas block 408 and gas port 410 to the gas block outlet 412, to provide the energy for a motive force to cycle the operating group 300. The motive force may be a reciprocal linear force resulting from the pressure of the impinging gas from the gas block outlet 412 in the rearward direction, and an opposite linear force from a recoil spring 608 disposed circumferentially around the operating rod.

The firearm 100 may further include a recoil spring 608 that provides a restoring force in opposition to the rearward movement of the gas piston 604. The restoring force causes the gas piston 604 to travel forward in the gas tube 602 until the gas piston 604 returns to a position adjacent the gas block outlet 412. Thus, each firing of the firearm 100 may result in a reciprocal motion of the gas piston 604 within the gas tube 602. The reciprocal motion of the gas piston 604 within the gas tube 602 with each firing of the firearm 100 provides the motive force to reciprocally move the operating group 300 within the receiver 200. The reciprocal motion of the operating group 300 may provide the input force for nearly all other operations of the firearm 100. For example, the motion of the operating group 300 after the firing of a first round and the introduction of high-pressure gas into the gas tube 602, unlocks the bolt 310 from the barrel extension 406, extracts a shell casing, ejects the shell casing, resets the trigger package 508, removes a second round from an ammunition source, inserts the second round into the barrel extension 406, and then locks the bolt 310 in the barrel extension 406.

As can also be seen in FIGS. 3 and 4, the firearm 100 comprises a top cover 700 which may interchangeably be referred to as a topcover assembly, configured to feed in a belt of ammunition. The top cover 700 feeds ammunition with a lever-activated feed driven by the roller 328 of the operating group 300. The roller 328 may follow a track (e.g., track 810 in FIGS. 6A-6B) in the top cover 700 providing an incremental, lateral feed of ammunition. The top cover 700 is specific to the type and size of ammunition being fired.

Figure 5:
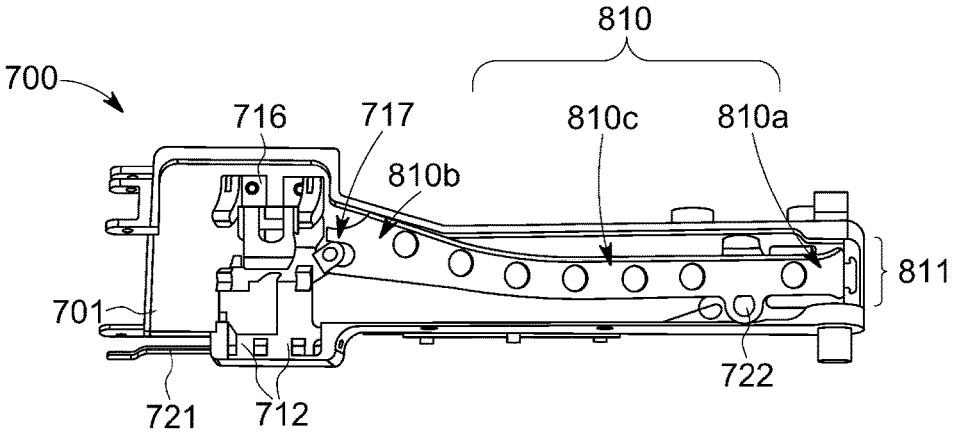
FIG. 5 is bottom assembled view of an example of a topcover assembly usable with aspects of the disclosure.
Figure 6:
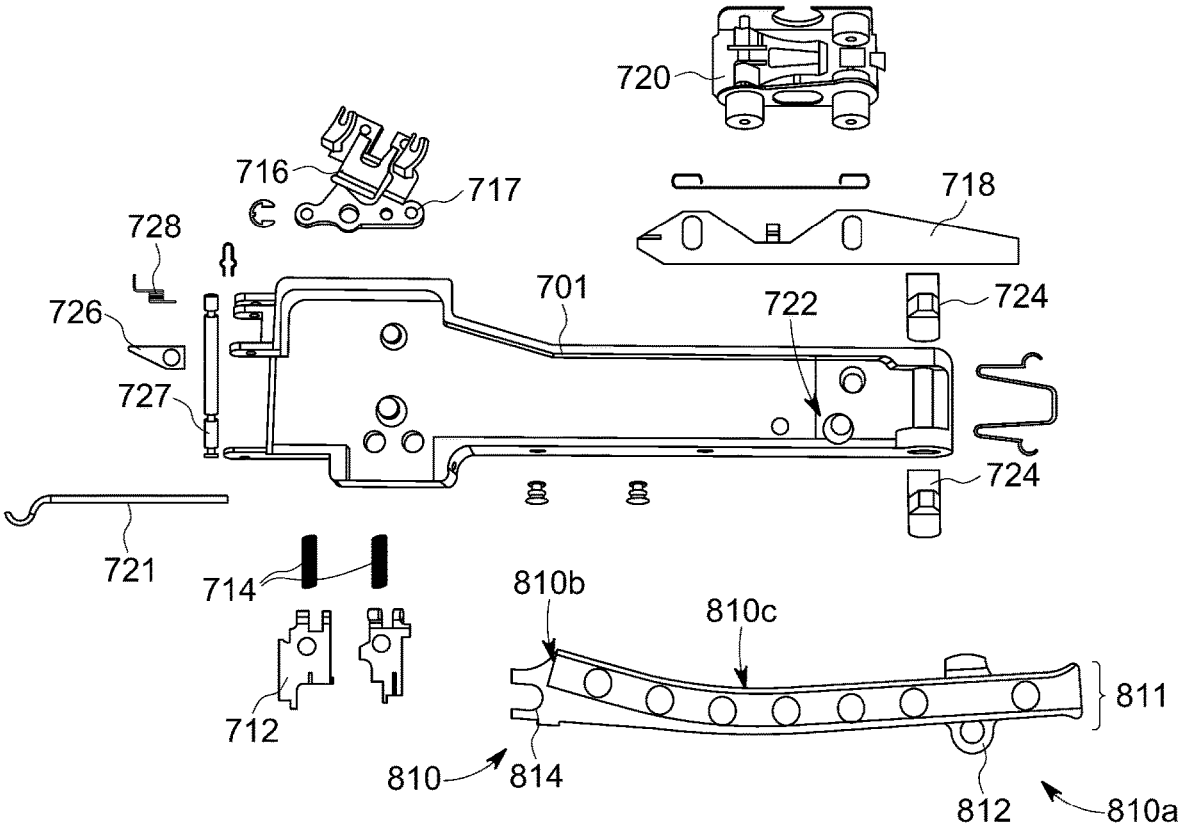
FIG. 6 is an exploded view of the example of a topcover of FIG. 5.

FIGS. 5 and 6 show an assembled and disassembled topcover assembly. As shown in FIGS. 5 and 6 the topcover comprises a topcover body 701, a latch cover(s) 724, a feed lever 810 configured to be pivotally mounted via pivot opening 812 to the topcover via topcover pivot protrusion 722. The feed lever 810 comprises a track 810*c* extending from a feed lever track first end 810*a* to a feed lever track second end 810*b*. Throughout the disclosure the feed lever may be interchangeably referred to as a feed arm. The feed lever 810 may further include a feed pawl driving portion 814 which may be semicircular or other rounded opening configured to receive a feed pawl driven portion 717 of the feed pawl 716. The feed pawl 716 may additionally interact with the cartridge retaining pawls 712 which are biased by compression springs 714. As the firearm is cycled, the interaction between the roller 328 (that cycles forward and backwards within the firearm) and the track 810*c* of the feed lever 810 causes the feed pawl 716 and pawls 712 to control the advancement of cartridges to be fired and in some cases controls de-linking of cartridges. While not shown, the top cover 700 may further include a sheet metal guide, which may be required for certain types of cartridges. During normal operation of a related art FN series firearm the roller 328 remains within the track 810*c* of the feed lever 810. In some cases, at the extreme most position during operation, the roller 328 stops and changes direction approximately 0.90 inches from the first end 810*a* of the feed lever 810.

In one aspect of the disclosure, the increase in cycling length of the firearm (and operating group 300) causes the roller 328 (FIGS. 3 and 4) to exit the track 810*c* of feed lever 810 before the roller 328 stops and changes direction. Once the roller 328 changes direction, the roller 328 may re-enter the track 810*c* of the feed lever 810 via a feed lever track exit portion at the first end 810*a*. This exiting and re-entering of the roller 328 may be assisted via a tapered or flared portion 811 at the exit portion of the first end 810*a*. In some aspects, the tapered or flared portion 811 may include a widened track portion, in other aspects that may be used as an alternative to or in combination with the widened track, the tapered or flared portion 811 may for example have any combination of ramps, chamfers or curved regions to help guide the roller 328 back into the first end 810*a* of the track 810*c* of the feed lever 810.

The topcover body 701 may further include a cocking channel cover 718, a retaining pin 721, a catch cover 726, a shoulder pin 727 and a helical spring 728. Additional hardware shown in FIG. 6 is unlabeled as these components are commonly used and understood in the art.

This disclosure improves the FN family of firearms in the following ways. First, the ergonomics of the weapon are improved to enhance functionality. Second, the travel of the operating group 300 is lengthened by increasing the length of the receiver, which was discovered to be too short for the task at hand, In addition, it was discovered that the stock takes up too much of the area behind the barrel/trunnion so improvements are made with regard to the location of the stock. Since the firearm uses well proven and fairly readily available components, these improvements retain a number of the original components allowing for efficient modification and improvement of the firearm.

In one example implementation, the firearm is improved while reusing a number of the standard components of the firearm—while modifying the receiver. One example of a modified receiver and the components configured to be mounted thereto are Ideally the improved disclosed receiver described herein could use either the existing components, or use some combination of existing and optimized parts (e.g. operating rod 606, sear block, carrier, etc.). This helps lower conversion cost.

The current receiver 200 has receiver guides 206*a* and 206*b* (FIGS. 2 and 3) that are too short for optimal receiver life or firing stability. When 5.56 mm cartridges are used, the receiver guides 206*a* and 206*b* are nearly adequate at about 5.65" or so, the distance with larger, longer cartridges such as the 7.62 mm NATO (and comparable cartridges) shorten the cycling distance by around half an inch or so which creates an inadequate cycling distance of just over 5 inches. This is with a cartridge that has about twice the power or kinetic energy (7.62 mm NATO being about twice as powerful in muzzle energy as the 5.56 mm). The use of the larger cartridge with the short receiver guides 206*a* and 206*b* creates an inadequate amount of cycling distance or stroke. To recap, the stroke or cycling distance is the movement from fully closed (bolt locked into battery, ready to fire) to fully open (bolt, op rod, etc. are fully to the rear of the receiver and have completed maximum rearward movement before cycling forward to sear stop or firing). This distance absorbs recoil and preventing "hard" or kinetic contact between the operating components and end of the receiver or end plate.

Figure 7:
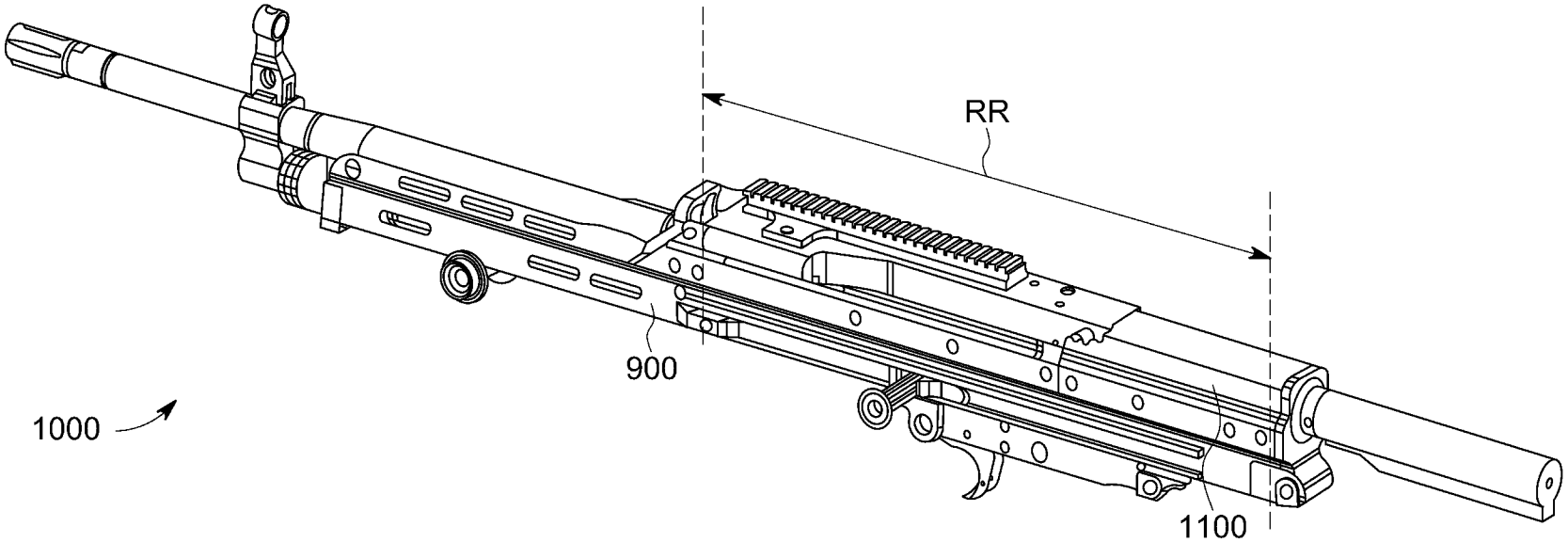
FIG. 7 a partial assembled view of a firearm according to aspects of the disclosure.
Figure 8A:
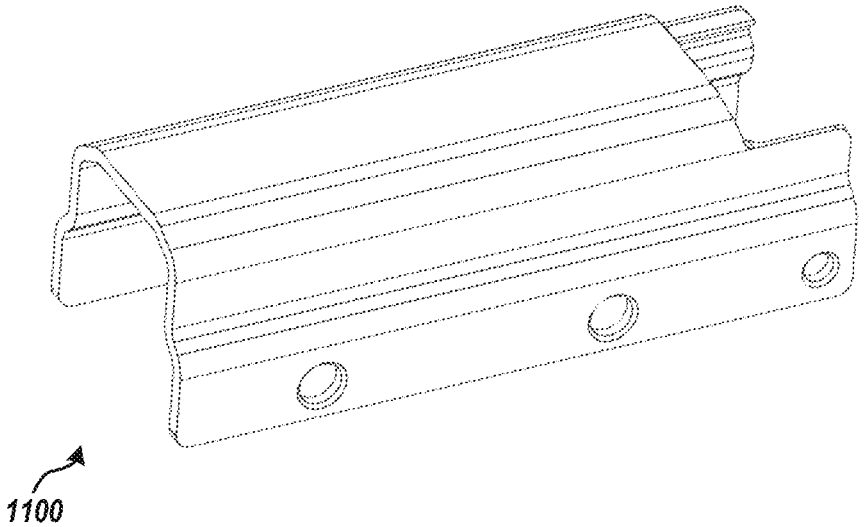
FIGS. 8A-8G are various views of the example design of the receiver extension bracket shown in FIG. 7 according to aspects of the disclosure.
Figure 8B:
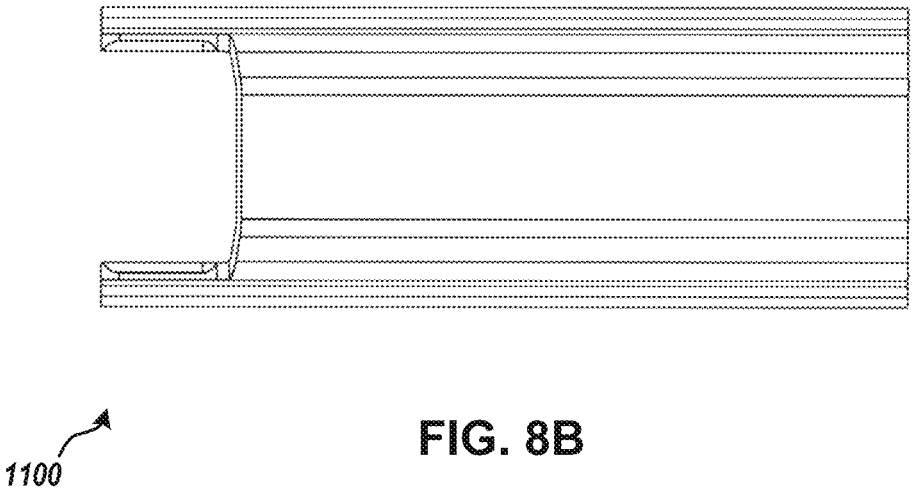
Figure 8C:
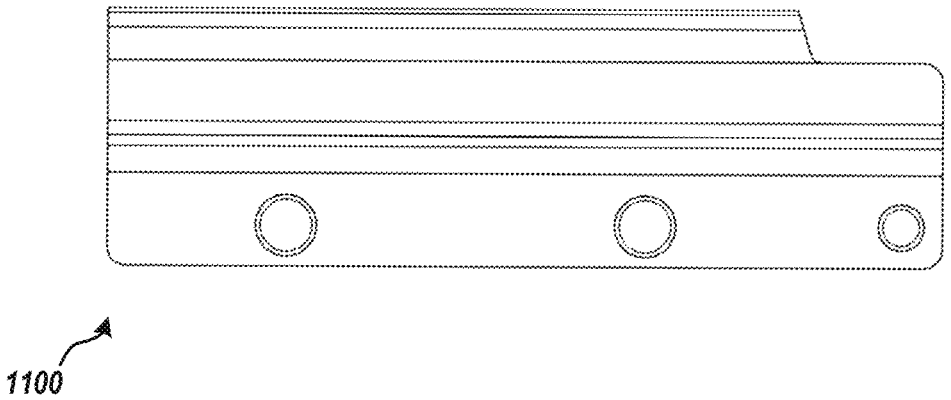
Figure 8D:
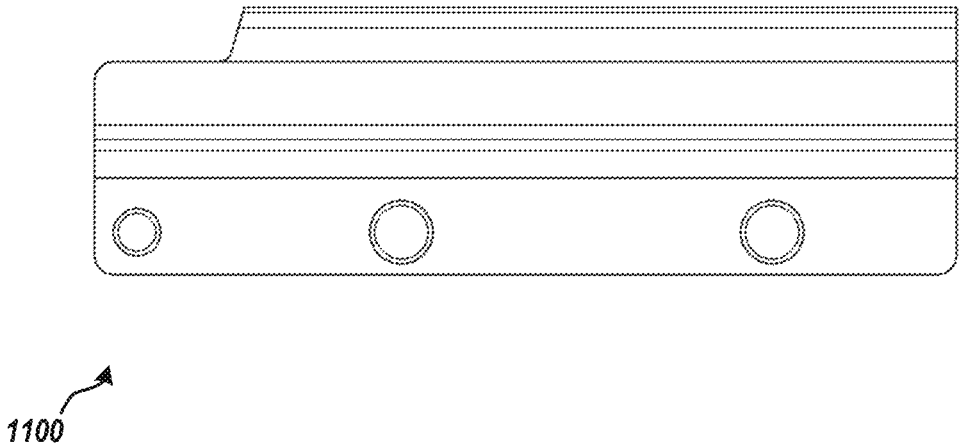
Figure 8E:
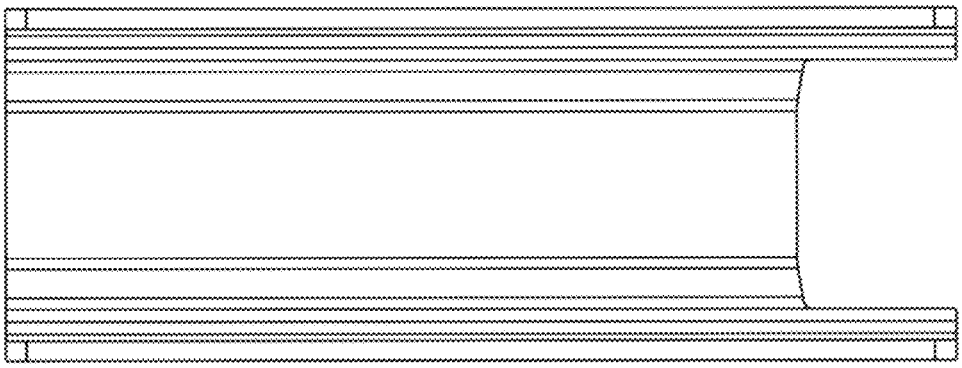
Figure 8F:
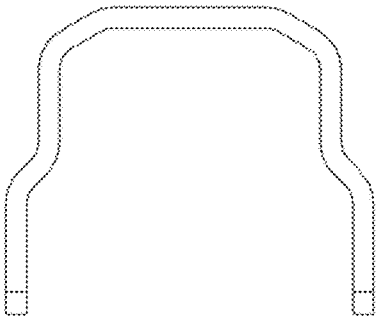
Figure 8G:
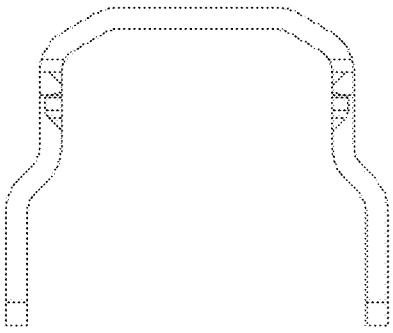
Figure 9A:
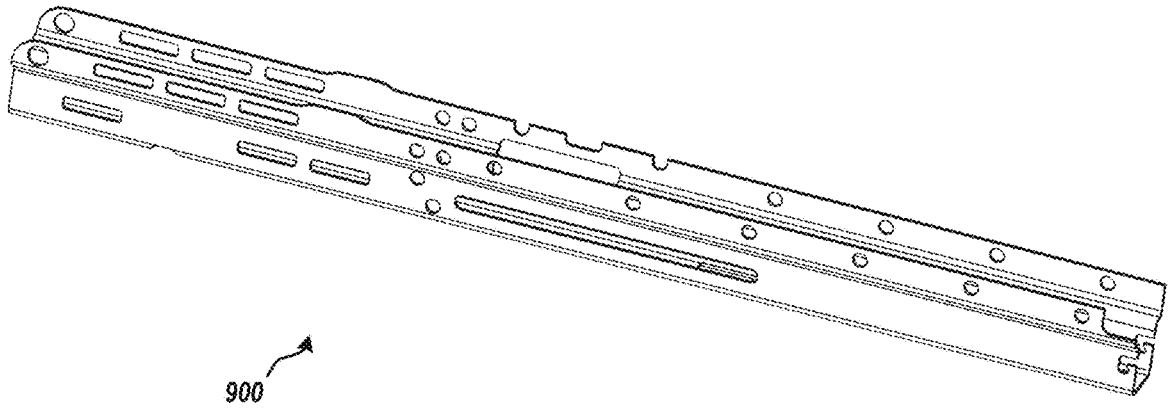
FIGS. 9A-9G are various views of the example design of the receiver subassembly shown in FIG. 7 according to aspects of the disclosure.
Figure 9B:
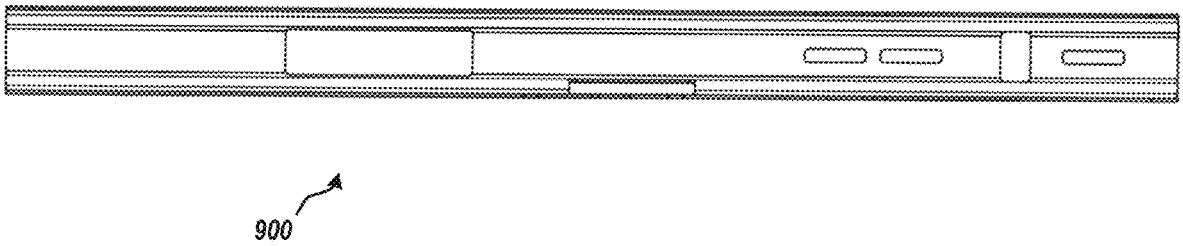
Figure 9C:
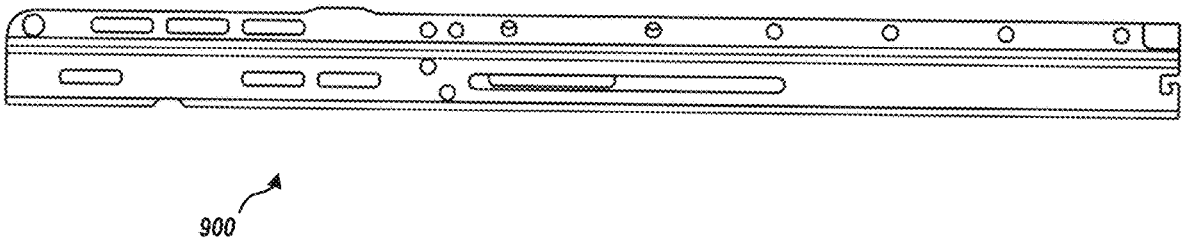
Figure 9D:
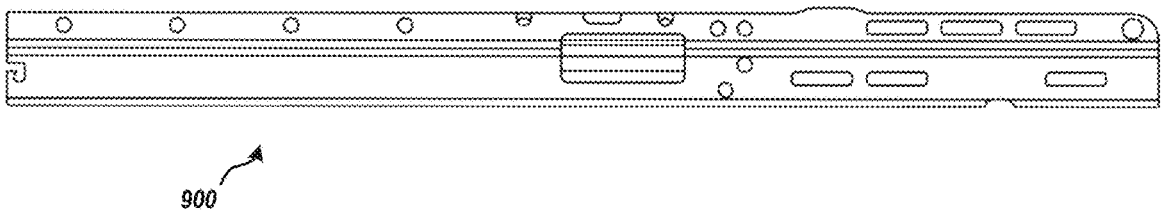
Figure 9E:
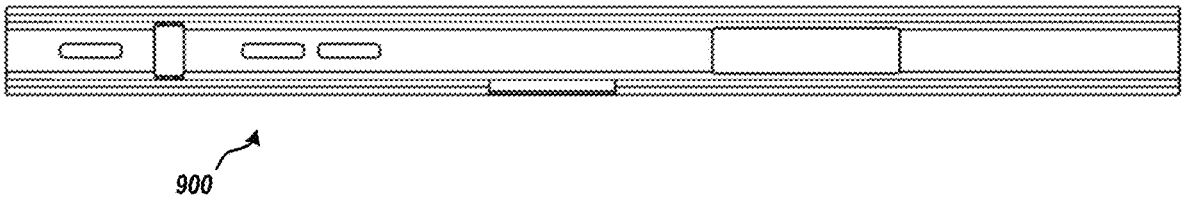
Figure 9F:
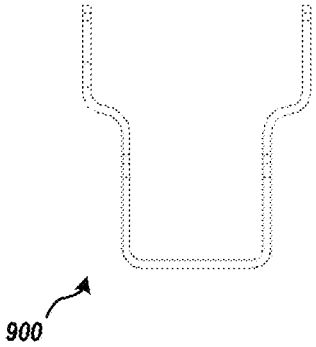
Figure 9G:
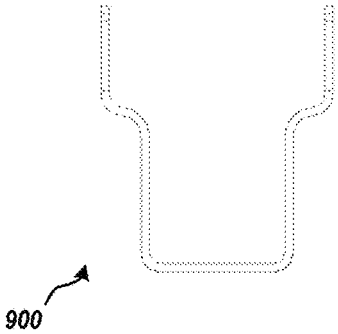
Figure 10A:
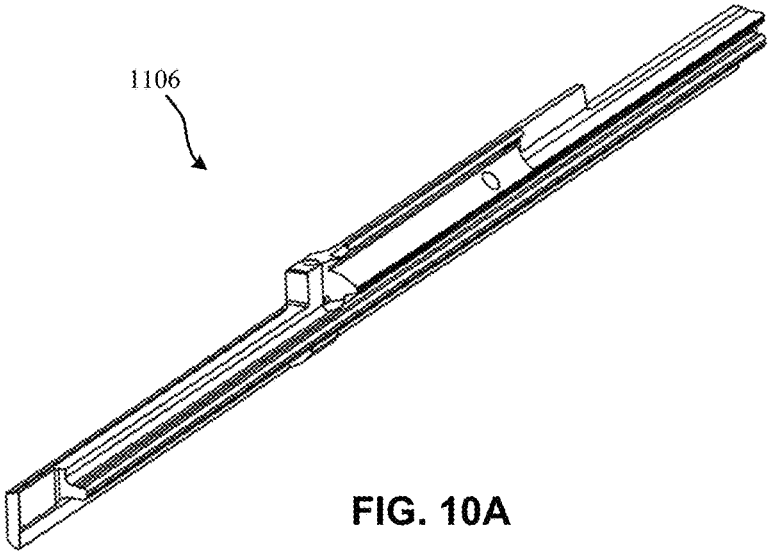
FIGS. 10A-10G are various views of the example design of a first guide rail that is configured to be mounted or welded to the receiver subassembly of FIGS. 9A-9G.
Figure 10B:
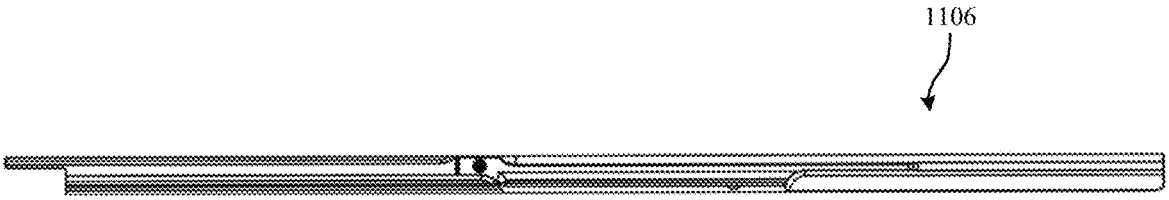
Figure 10C:
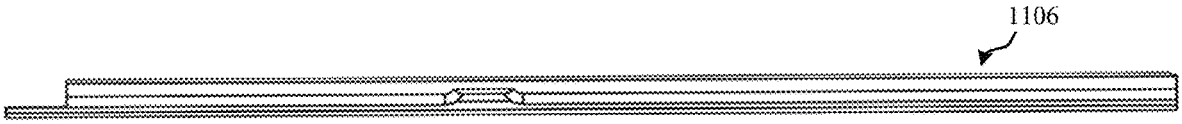
Figure 10D:
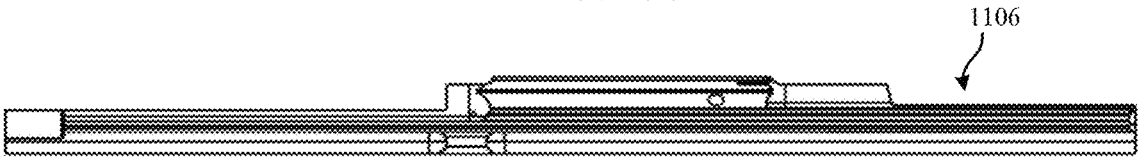
Figure 10E:
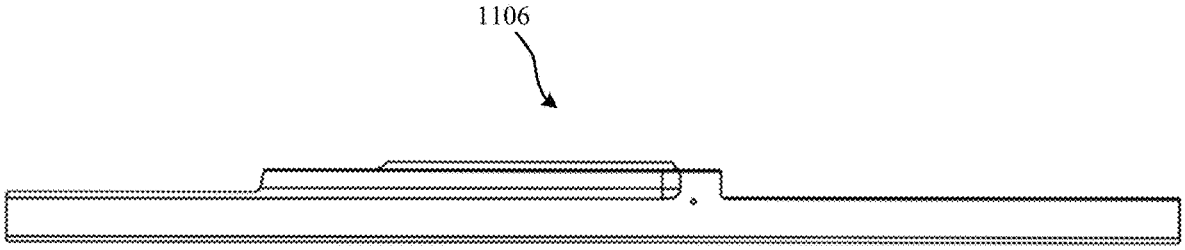
Figure 10F:
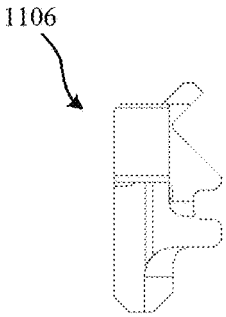
Figure 10G:
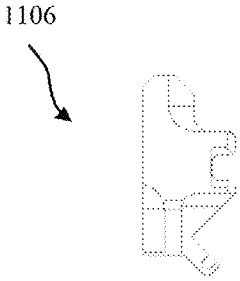
Figure 11A:
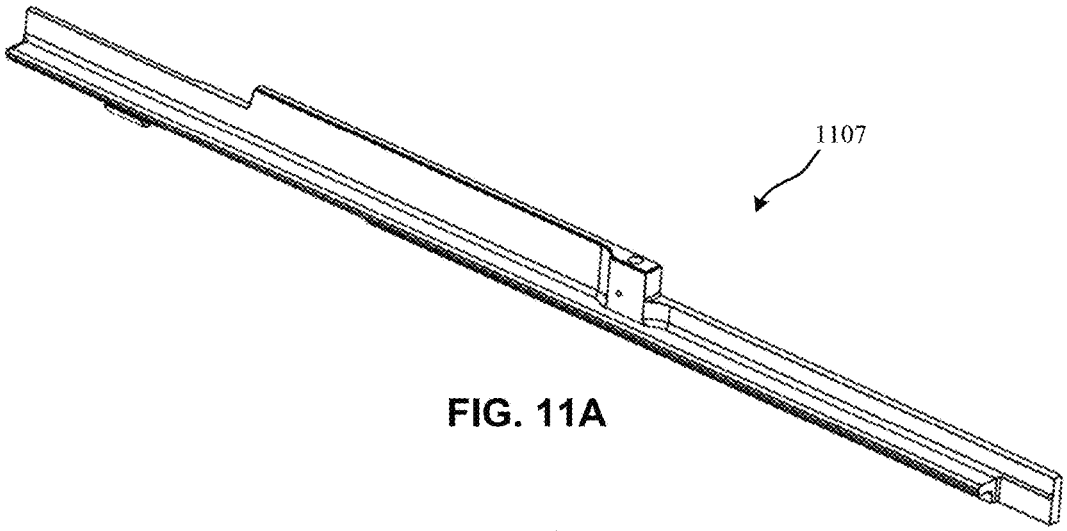
FIGS. 11A-11G are various views of the example design of a second guide rail that is configured to be mounted or welded to the receiver subassembly of FIGS. 9A-9G.
Figure 11B:
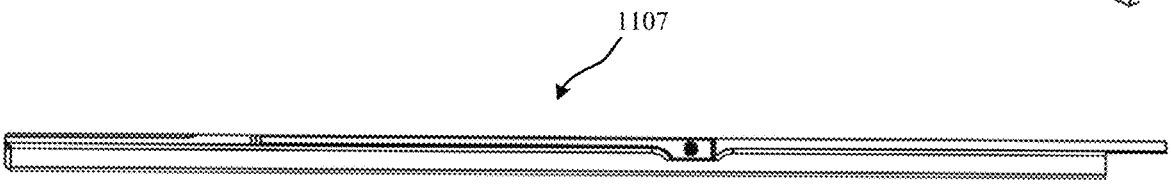
Figure 11C:
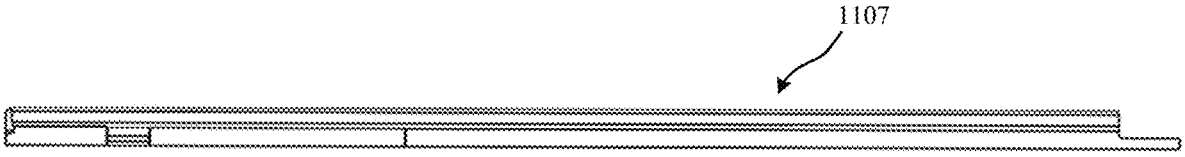
Figure 11D:
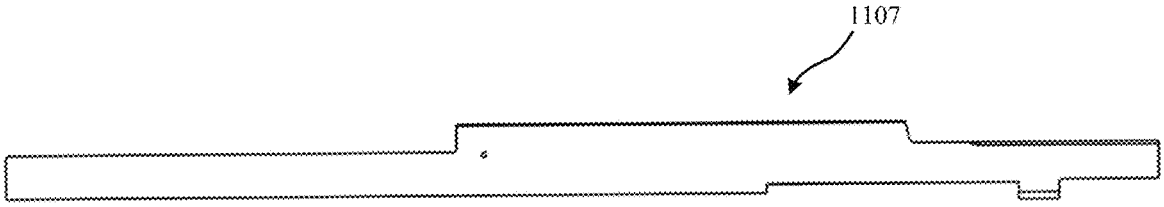
Figure 11E:
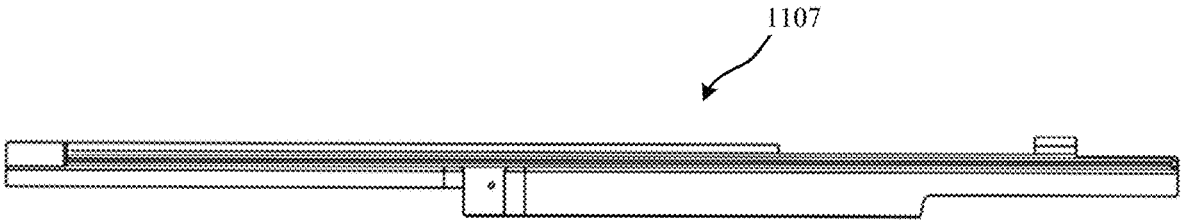
Figure 11F:
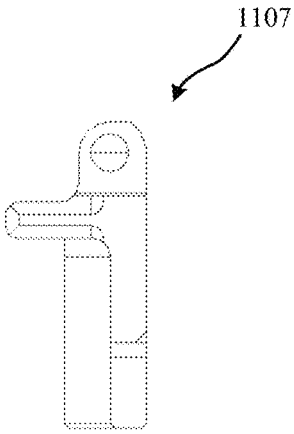
Figure 11G:
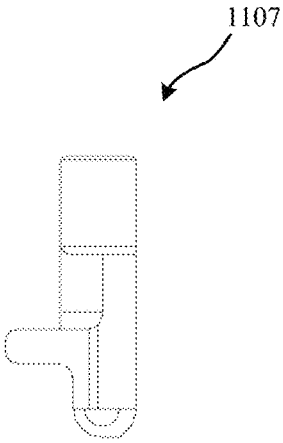
Figure 12A:
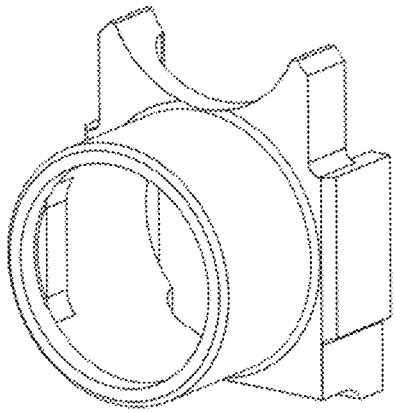
FIGS. 12A-12G are various views of one example of a cradle configured to be mounted or welded to a first end of the receiver subassembly of FIGS. 9A-9G.
Figure 12B:
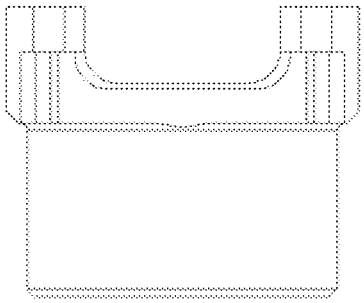
Figure 12C:
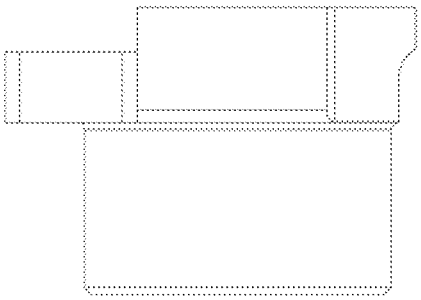
Figure 12D:
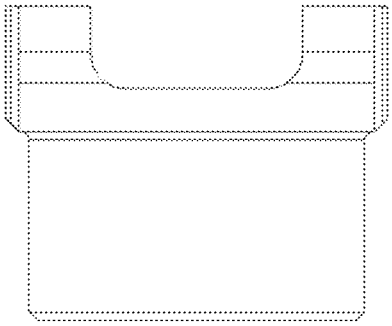
Figure 12E:
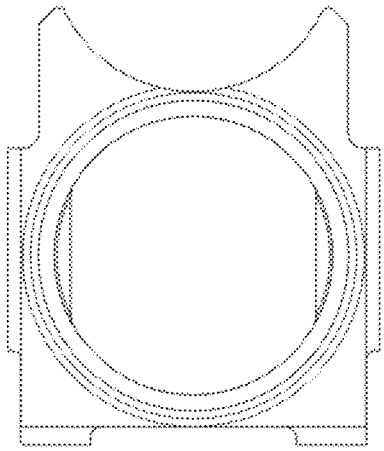
Figure 12F:
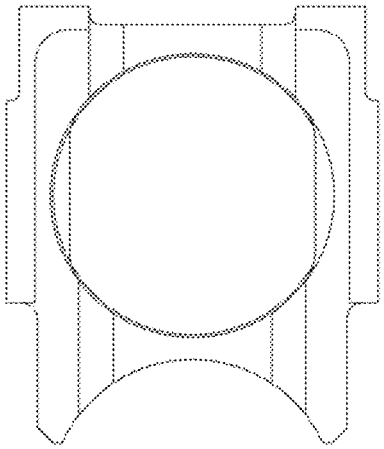
Figure 12G:
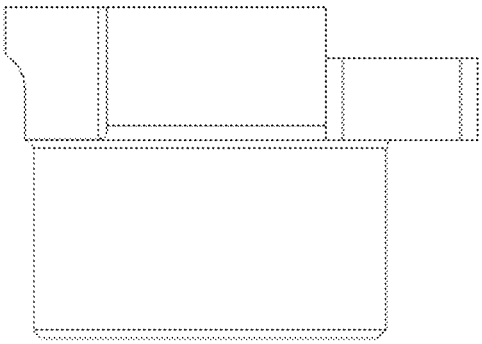
Figure 13A:
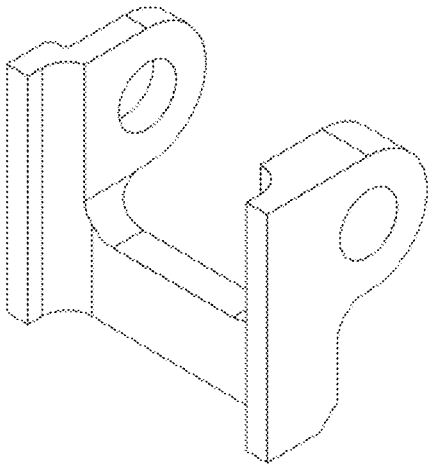
FIGS. 13A-13G are various views of one example of a trigger housing support bracket configured to be mounted or welded to the receiver subassembly of FIGS. 9A-9G.
Figure 13B:
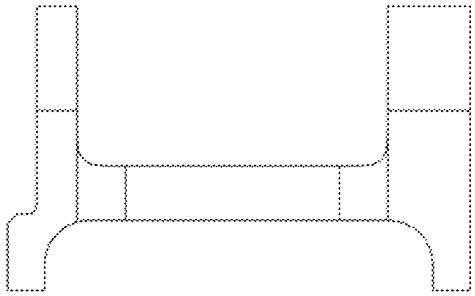
Figure 13C:
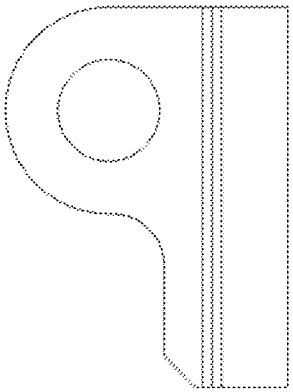
Figure 13D:
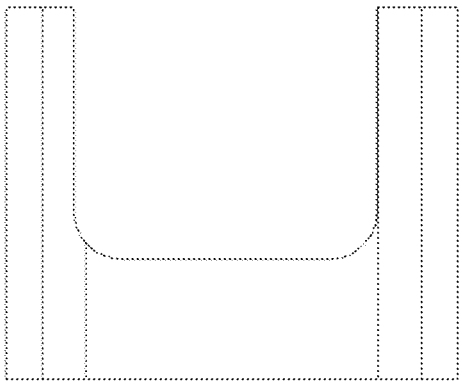
Figure 13E:
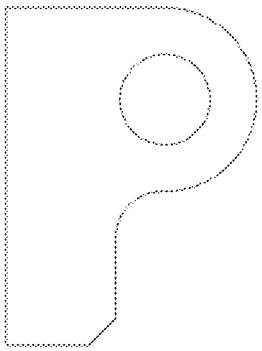
Figure 13F:
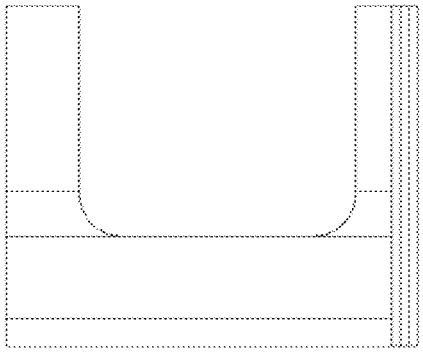
Figure 13G:
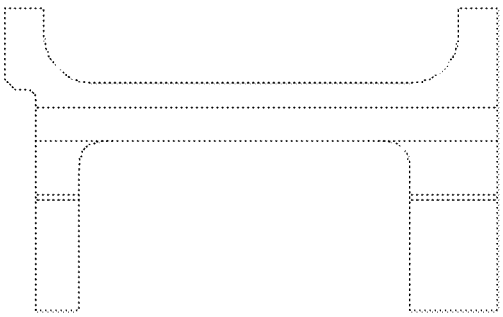
Figure 14A:
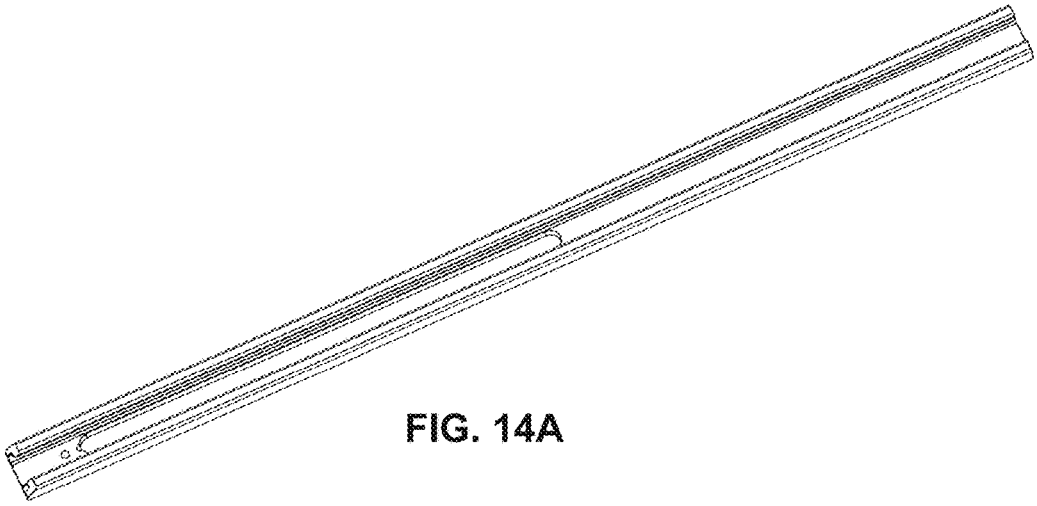
FIGS. 14A-14G are various views of one example of a charging handle guide slot configured to be mounted or welded to the receiver subassembly of FIGS. 9A-9G.
Figure 14B:
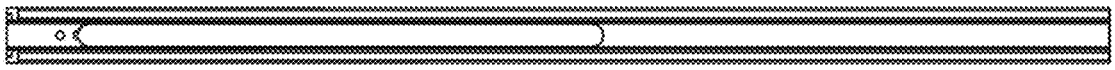
Figure 14C:
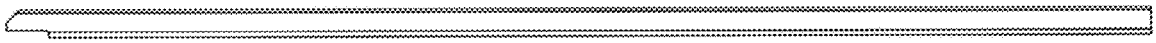
Figure 14D:
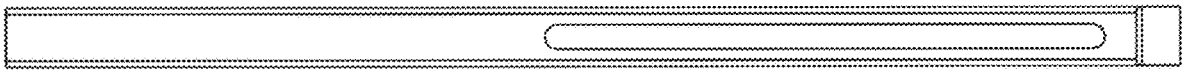
Figure 14E:
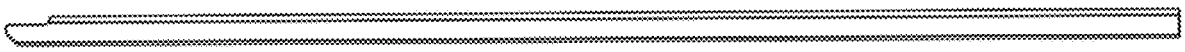
Figure 14F:
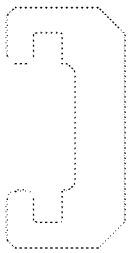
Figure 14G:
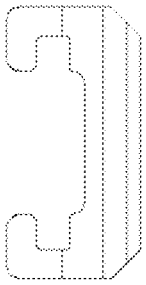
Figure 15A:
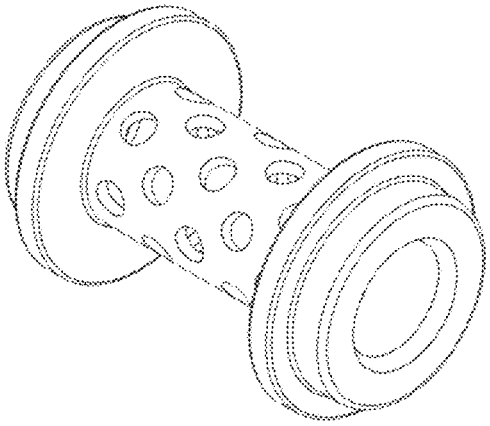
FIGS. 15A-15C are various views of one example of a forward bracket or tripod mount configured to be mounted or welded to the receiver subassembly of FIGS. 9A-9G.
Figure 15B:
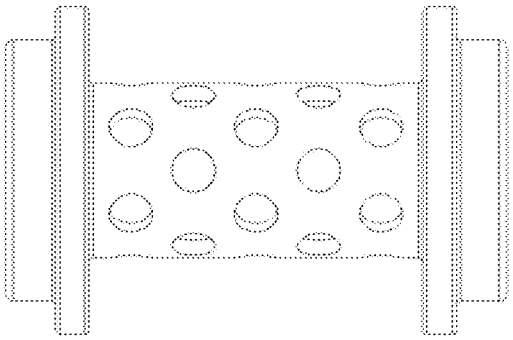
Figure 15C:
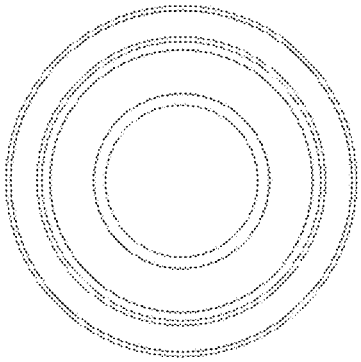
Figure 16A:
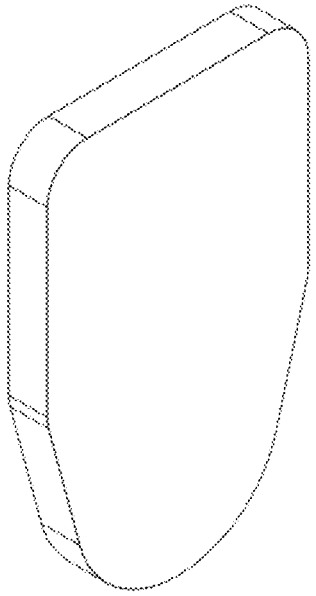
FIGS. 16A-16B are various views of one example of a receiver end plate according to aspects of the disclosure.
Figure 16B:
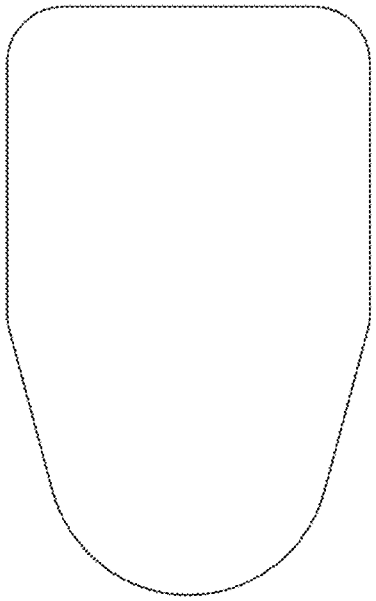

In one aspect of the disclosure, a receiver with lengthened receiver guides is disclosed. FIG. 7 shows one example of a partially assembled firearm with a lengthened receiver 900. FIGS. 9A-9G show a first portion of a lengthened receiver configured to have lengthened receiver rails (e.g., receiver rails 1106 in FIGS. 10A-10G and 1107 in FIGS. 11A-11G) mounted thereto. In some examples, the receiver rails 1106 and 1107 may be welded to the lengthened receiver 900 to form a receiver assembly allowing for increased travel of the OP group (e.g, operating group 300 shown in FIGS. 3 and 4). Commonly, the distance that the slide guides left receiver rail 206*a* and right receiver rail 206*b* (FIGS. 2 and 3), which may hereinafter be interchangeably referred to as slide guides is less than 9.5 inches from the rear of the trunnion 208 to the end of the receiver rails 206*a* and 206*b*. In one aspect of the disclosure, the travel distance RR (FIG. 7) for the slide guides (e.g., guides 1106 and 1107 in FIGS. 10A-11G) from the trunnion to the rear most point is increased to greater than 9.5 inches (9.5"). In one aspect, the slide guides are lengthened any possible amount—preferably at least 0.10-0.50", more preferably at least about 0.45-1.00", even more preferably at least about 0.95-2.00", and most preferably at least about 1.95-3.50" or more. Additional movement beyond about 3.25-3.50" is possible to about a limit of 7-9.50" in extension. In one example, the total travel length (i.e., the sum of the standard length of approximately 9.5" from the trunnion to the rear of the rails and the lengthened amount) indicated by RR in FIG. 7 may be equal to or between 10.5" and 17". In addition to lengthening the slide guides (e.g., guides 1106 and 1107 in FIGS. 10A-11G), the receiver body may be lengthened to accommodate the larger portions of this increase. The balance between stock length and receiver length aft of the trunnion (where the barrel and gas tube are held in place on the receiver) may be shifted from the current balance (using a standard fixed stock as reference, adjust as necessary when using an adjustable or collapsible stock) of 10.5" receiver/9.5" stock, that is where the Receiver uses about 52.5% of the space (defined by split between Receiver length vs stock length) aft of the trunnion. The stock should be measured at the maximum length in the case of collapsible or adjustable stocks.

In one aspect, the stock will use less overall space, and the ideally lengthened receiver will use more than about 53% or more of the space aft of the trunnion. This could be, based on redesign of the stock and receiver from 53-60%, and preferably about 60-70% of the space, and more preferably about 70-80% of the space, even more preferably 80-90% of the space, and with sufficient redesign of the stock and receiver even most preferably about 90-98% of the space. Some space is necessary for the buttstock, and the Receiver will need to be improved to permit a "cheek weld" on the receiver of the weapon—which is one shortcoming of the known M249. Using the aforementioned aspects, the ergonomics would be improved over what is known in the art.

The stock may be much more closely aligned with the receiver and sights/optic rail. The SAW et all have suffered from many years from a stock whose cheek mount portion is far too low beneath the sights and sighting plane—with this change the stock cheek weld portion and top of the feed tray cover (where the rear sight and optic rail are located) will offer far better ergonomics—the space between the top edge of the stock and rear sight etc., will be reduced from the current dimension of about 3-6", to less than this amount.

In another alternative aspect, an extension may be used to accommodate the additional length in cycling space which bolts or pins on etc. (via any feasible method) to provide more space.

Operating Assembly

In one aspect, the cycling stroke may be increased beyond current capacity in the SAW et al is by increasing the number of sear notches in the piston assembly (or "OP rod") to three or more, instead of the current two positions. This will enable capture of the Operating Assembly (including OP rod, slide assembly/or carrier and bolt) properly when increasing the stroke of the firearm. Currently the primary sear notch is located about mid-way (about half way between the front and back of said block) in the "block" that the piston OP rod screws into—that is the block that mounts via pin to the slide assembly. The slide assembly holds the bolt and controls rotation of the bolt via a helical slot. The helical slot uses about 24% of the slot length for rotation, the author discloses increasing this percentage to more than 25%, preferably to as much as 50% or more of the slot, and ideally to as much as 75-85% of the slot. This can be done via adjustments apparent to those skilled in the art. The length of the helical slot can also be increased by any amount, which will be beneficial—but even more so if increased by about 3-20%, and preferably 20-50%. More increase is possible with bolt optimization. The helical tab on the bolt—which fits in the slot—should be reduced in length (from front to rear) as much as possible to increase the effective or net size of the helical slot. In other words, this change will serve to increase possible Bolt travel within the slide assembly.

The sear notch may be moved forward of the current forward most position (primary) in the forward half or so of the block that is aft of the OP rod. The OP rod is the component that holds the action spring and is located aft of the piston. The net length of the block can be extended forward by some distance—appears to optimally be about ½-¾" or so. Alternately the OP rod may be milled to have a sear slog as well should that be considered preferable. These will serve to take advantage of additional cycling distance and capture the bolt etc., more rearwardly than is currently possible. This improvement provides more positive operation and more reliable feeding by increasing the bolt "runup" (spring loaded movement) before the bolt/slide assembly contact the cartridge and link in the ammunition belt.

The gas cylinder assembly may alternatively or additionally be shortened to allow more clearance for a "forward" sear notch as described. And the OP rod may be shortened as applicable with any changes to the Block that the current two (2) sear notches are located on. The sear notches may be moved closer together than they are currently as desired to accommodate an increase in the number of notches. The sear notches serve to stop automatic fire as desired when the trigger is released—they act as a safety mechanism to a "runaway gun" (that is one that continues to fire even when the trigger is released), thus the increase to more than two also creates increased safety.

The action spring may be increased in length (currently about 18.5") and the spring "rate" may be changed to optimize the change in length. Also the return rod (which serves to guide the action spring that fits in the OP rod) may be changed in length—preferably lengthened, though shortening may be necessary with the increased movement. Changes in length refer to the spring guide rod and the "block" or "cylinder" portion aft of the rod.

The feed lever may be increased in length (about 6" or so now), or may remain as is in size. A large improvement will be to put a channel aft of the Feed Lever in the top of the receiver—this channel may help guide and transition the top cylindrical roller portion ("roller") of the slide assembly once this portion transits past the feed lever, which may happen with increased cycling length described above. The new "channel" may be fixed in the receiver, or it may be accessed via opening portion (similar to how the feed cover opens to allow access). The same may be accomplished by increasing the length of the feed lever and topcover/feed mechanism. preferably the topcover etc., will reuse the existing components.

Channel Aft of Feed Lever

The "channel" should increase by the amount of desired increase in the stroke of the gun, as will the slide guides. The receiver may be increased in length beyond a certain point. The current reinforcement bracket located at the rear end of the receiver (where the buttstock mounts) may be eliminated with an increase in the receiver length, or it may be retained in standard or modified form as a "mid receiver" reinforcement bracket to increase receiver strength and stiffness. A further aft reinforcement bracket may be added as desired. The bracket may remain as is an allow passage of the feed roller, and if optimized in configuration (to bring closer up to planar surface formed by top of feed tray cover) may sever as a mounting point for the channel as described.

A new rearward bracket may use a stock that slides via mounting surface into receiving areas of the bracket. This allows access to the action spring and guide rod as well as the OP rod/slide assembly since the receiver rear may now be "closed" as modified.

The sear (located proximate to the trigger) may be increased in length to enable travel or as otherwise preferred.

Receiver Reinforcement

The receiver may be also improved by the use of dual, or ambidextrous, charging handles (CH). Currently the Weapon only uses a right hand version.

By putting the CH guide slots on a lower plane (i.e. lower, towards the bottom of the Receiver from current position) than the one currently on the right side of the weapon, guide slots may be located on both sides of the receiver. Currently the CH handle is about 3-4" forward of the engagement point of the slide assy. By locating the engagement point (where the CH meets or contacts the slide assembly) on a lower portion of the slide assembly or the block rearward of the OP rod, the ambidextrous CH can be more readily fit. This is due to clearance on the feed tray. Currently the engagement point on the CH sits generally above the slide assembly, just below the "roller". In one aspect, lowering it within the receiver and bringing the CH handle portion closer to the engagement point may improve performance. The contact portion may also contact between the block (which has sear notches) and the slide assembly. In one aspect, it could contact to the OP rod. Preferably the CH handle will be closer than 3-4" to the contact portion contacting the operating assembly (OP assembly). This reduced space allows more flexible location on the weapon, and less parasitic drag of the CH.

The CH guide slots may be notched or otherwise designed to permit mechanical locking of the OP assembly on points other than the sear notches. This is useful for immediate action/remedial steps in case of firing stoppage.

Rather than protruding permanently from the receiver, the CH "handle" portion should be foldable, ideally spring loaded so that it minimizes potential interference. This is especially important because the SAW class of weapon is often carried employed by a single operator.

The dual CH guide slots may serve as reinforcement to the strength and stiffness of the receiver. Ideally they may be attached about the trunnion and bracket(s) as described above to further strengthen the receiver. Additional brackets may be added internally or externally to optimize receiver operation and reduce firing wear and vibration. This permits the OP assembly to operate with maximum stability.

The "slots" in the slide assembly that the slide guides constrain should use a radius (or less preferably chamfer, etc.) to further increase operating smoothness and decrease wear to the slide guides. The slots are the contact area that engage the slide guides and currently have abrupt sharper edges where basically about 95-100% of the length may contact the slide guide. By offering a radiused surface on this feature, the contact area between the slots will be less than about 95% of the total length of each slot, and preferably about 70-94.9% or so. The amount of radius about the edges must be adjusted to ensure that adequate contact area is maintained to the Slide Guides. It appears that a preferable ratio is about 80-94.9%, with a similar radius applied to the outer (longitudinal) edge of the slot.

The operating assembly (OP Rod, slide assembly, "block" portion with sear notches, bolt, etc.) may be lightened by reducing the amount of material, or applying lightening cuts or slots as applicable. It is important to maintain strength in all of these critical components. One area that can have material added is the bolt face that surrounds the cartridge rim. This area appears to be able to accommodate about a 3-30% growth in thickness. The bolt lugs should be radiused to the maximum extent possible to ensure the smoothest operation possible.

Secondary Opening

The receiver may use a cover that folds (which covers the top of the Receiver) that is about aft of the current rear Bracket and in front of the buttstock. Ideally this cover will fold or tilt to the side of the weapon to ensure optimal access. The secondary cover (above) will allow operator access to the rear portion of the receiver that is now aft of the current feed tray cover. Ideally this folding/tilting secondary cover will allow access to the now extended portion of the receiver-which may improve reliability and efficiency as a feature in the case of any malfunctions or stoppages—the operator can then look to see any problems when the secondary cover is opened.

Ideally there will be a transition area on both the end of the feed lever as well as the new "Channel" (as described above for the roller (wherein the openings of the channel and feed lever are both slightly flared (e.g., as described above with respect to FIGS. 6A and 6B). This permits smooth reliable operation even if the extension area with the channel is not perfectly aligned with the receiver portion with the feed Lever. The secondary opening (which may fold or tilt) may effectively be used as a cheek piece and help maximize shooter comfort. The buttstock may use an adjustable length of pull and an adjustable comb or cheek height to accommodate the widest range of optics, electro optics, and shooters.

Gusseting and Brackets

The use of a Bracket enclosure wherein the "roller" transits through the bracket area (which is preferably still closed or encircled on the top portion of the receiver) is repeated. The receiver may ideally transit rearwardly from this area. Ideally the stock attachment will go from a rotating attachment that is pinned on to a receiver enclosure that offers a sliding bracket mount between the Receiver and the stock assembly. This would enable two full enclosures (i.e. 360 degree coverage) reinforcement brackets aft of the trunnion. This will offer unprecedented levels of receiver strength and stiffness, which will ensure more reliability and far more smoothness in operation. This should also reduce vibration and increase part life.

Additional reinforcement brackets (U shaped where necessary and the receiver top needs to open for feed tray access, for example) may be attached to the guide slots or other longitudinal reinforcement as well as the brackets as described to ensure the most rigid receiver possible. This can be accomplished with minimal weight increase.

While a number of example aspects and aspects have been discussed above, those of skill in the art will recognize that still further modifications, permutations, additions and sub-combinations thereof of the features of the disclosed aspects are still possible. It is therefore intended that the following appended claims and claims hereafter introduced are interpreted to include all such modifications, permutations, additions and sub-combinations as are within their true spirit and scope.

What is claimed is:

1. A firearm comprising:

a receiver configured to slideably support an operating group having a roller, wherein the operating group and the roller cycles forward and rearward while constrained by the receiver as the firearm cycles;

a topcover assembly having a feed lever pivotally mounted thereto, wherein the topcover assembly is configured to advance cartridges to be fired by the firearm, the topcover assembly further comprising:

a feed lever track of the feed lever configured to slideably receive the roller, wherein the feed lever comprises a feed lever first end with a feed lever track exit portion, and wherein the roller exits and re-enters the feed lever track via the feed lever track exit portion end as the firearm cycles.

2. The firearm of claim 1, wherein the feed lever further comprises a feed lever second end with a feed pawl driving portion configured to transmit a feed force provided by the roller to a feed pawl driven portion.

3. The firearm of claim 1, wherein the feed lever track exit portion further comprises a flared region configured to guideably receive the roller when the roller returns to the feed lever track as the firearm cycles.

4. The firearm of claim 3, wherein the flared region comprises a track having a track width wider than the feed lever track.

5. A topcover assembly for a firearm comprising:

a topcover assembly, wherein the topcover assembly is configured to advance cartridges to be fired by the firearm, the topcover assembly further comprising:

a feed lever pivotally mounted to the topcover assembly with a feed lever track configured to slideably receive a roller of the operating group, wherein the feed lever comprises a feed lever first end with a feed lever track exit portion, and wherein the roller exits and re-enters the feed lever track via the feed lever track exit portion end as the firearm cycles.

6. The topcover assembly of claim 5, wherein the feed lever further comprises a feed lever second end with a feed pawl driving portion configured to transmit a feed force provided by the roller to a feed pawl driven portion.

7. The topcover assembly of claim 5, wherein the feed lever track exit portion further comprises a flared region configured to guideably receive the roller when the roller returns to the feed lever track as the firearm cycles.

8. The topcover assembly of claim 7, wherein the flared region comprises a track having a track width wider than the feed lever track.

9. The topcover assembly of claim 7, wherein the operating group cycles forward and rearward while constrained by the receiver as the firearm cycles.

10. A feed lever for a firearm comprising:

a feed lever body having a feed lever track, wherein the feed lever body is configured to be pivotally mounted within a topcover assembly, and wherein the feed lever body is configured to pivot in response to a force transmitted by a roller of an operating group to the feed lever track during cycling of the firearm; and a feed lever track first end, wherein the feed lever track first end comprises a feed lever track exit portion configured to receive the roller of the operating group after the roller exits the feed lever track via the feed lever track exit portion as the firearm cycles.

11. The feed lever of claim 10, wherein the feed lever further comprises a feed lever second end with a feed pawl driving portion configured to transmit a feed force provided by the roller to a feed pawl driven portion to advance from a first cartridge to a second cartridge.

12. The feed lever of claim 10, wherein the feed lever track exit portion further comprises a flared region configured to guideably receive the roller when the roller returns to the feed lever track as the firearm cycles.

13. The feed lever of claim 12, wherein the flared region comprises a track having a track width wider than the feed lever track.

14. The feed lever of claim 12, wherein the operating group cycles forward and rearward while constrained by the receiver as the firearm cycles.

* * * * *